US005964586A

United States Patent [19]

Ødemark et al.

[11] Patent Number: 5,964,586

[45] Date of Patent: Oct. 12, 1999

[54] METHOD, APPARATUS, AND IGNITION DEVICE FOR IGNITION OF INFLAMMABLE GASES FROM A FLARE ON A FLAME TOWER

[75] Inventors: Tom Ødemark, Hosle; Sjur Dagestad, Bekkestua, both of Norway

[73] Assignee: Techno Consult A.S., Sandvika, Norway

[21] Appl. No.: 08/817,567

[22] PCT Filed: Oct. 9, 1995

[86] PCT No.: PCT/NO95/00183

§ 371 Date: Apr. 11, 1997

§ 102(e) Date: Apr. 11, 1997

[87] PCT Pub. No.: WO96/12142

PCT Pub. Date: Apr. 25, 1996

[30] Foreign Application Priority Data

Oct. 12, 1994 [NO] Norway ..... 943851

[51] Int. Cl.[6] ..... F23D 5/00; F23D 14/00

[52] U.S. Cl. ..... 431/202; 431/91; 431/269; 431/5

[58] Field of Search ..... 431/202, 91, 269, 431/270, 286, 283, 5; 102/336, 342

[56] References Cited

U.S. PATENT DOCUMENTS

| | | | |
|---|---|---|---|
| 1,633,567 | 6/1927 | Breese, Jr. | 431/270 |
| 2,696,875 | 12/1954 | Henwood | 431/202 |
| 2,830,658 | 4/1958 | Smith | 431/202 |
| 3,729,287 | 4/1973 | Strashok | 431/202 |
| 3,827,360 | 8/1974 | Geimer | 102/70 F |
| 4,025,281 | 5/1977 | Lapp | 431/202 |
| 4,086,049 | 4/1978 | Swanson | 431/269 |
| 4,431,402 | 2/1984 | Hamilton | 431/202 |
| 4,449,920 | 5/1984 | Lerouge et al. | 431/91 |

FOREIGN PATENT DOCUMENTS

| | | |
|---|---|---|
| 177162 | 7/1995 | Norway . |
| 94/29648 | 12/1994 | WIPO . |

*Primary Examiner*—Ira S. Lazarus
*Assistant Examiner*—Josiah C. Cocks
*Attorney, Agent, or Firm*—Pillsbury Madison & Sutro LLP

[57] ABSTRACT

There are described a method, an apparatus and an ignition pellet for the ignition of combustible gases, for example from a flare or flare tower, where an ignition pellet is launched in a direction toward a region of combustible gas, characterized in that the ignition device is propelled by means of a pressure medium through a guidance tube to the gas cloud region, that the ignition device undergoes a reaction for the purpose of active ignition of the gas in the region, the time for its activation and reaction being predetermined and adapted to the particular flare and application. The reaction of the ignition device is in the form of a shower or cloud of sparks where at least parts of the shower of sparks will strike the cloud of gas. The ignition device is activated somewhere along its path through the tube, possibly at the moment when the ignition device leaves the tube, possibly when the ignition device starts its journey through the tube, or possibly by the fact that the ignition device strikes an object in the vicinity of the flare. The ignition device may be positioned within a trapping device prior to the reaction of the ignition device. The ignition device may be propelled through the guidance tube at a moderate speed, may optionally be stopped during its passage through the tube and may optionally be reversed and returned back into the guidance tube without a reaction taking place.

7 Claims, 3 Drawing Sheets

METHOD, APPARATUS, AND IGNITION DEVICE FOR IGNITION OF INFLAMMABLE GASES FROM A FLARE ON A FLAME TOWER

This application is the national phase of the international application PCT/NO95/00183, filed Oct. 9, 1995 which designated the U.S.

FIELD OF THE INVENTION

The present invention relates to a method, an apparatus, and an ignition device for igniting combustible gases, for example, from a flare of a flare tower, where an ignition device is launched toward a region of combustible gas.

BACKGROUND OF THE INVENTION

With respect to the ignition of gas flows, for example, in a flare, a distinction may be made between two different ignition techniques. One technique is a point ignition system, where the gas is ignited only at one point. This can be achieved by means of, for example, a match, a pilot burner, or a flame front generator. A prerequisite for point ignition is that the gas, concentration at the point of ignition is between the lower and the upper detonation line. The other technique is a volume ignition system, where ignition occurs through sparks being scattered over a large area and the gas in this area is ignited. The latter technique is a great deal more reliable than the point ignition system.

Norwegian Patent Application No. 932017 teaches a method for the ignition of combustible gas emitted through a flare in a flare tower. The ignition device is a projectile which is fired toward the gas outlet. The ignition device strikes an impact plate mounted at the gas outlet, whereby the ignition device undergoes a reaction and brings a flow of incandescent particles into the gas flow which is ignited. Thus, the ignition device is detonated by impact. This method has a number of inconveniences. For instance, the equipment used is excessively complicated. One reason therefor is that the ignition device is fired by means of very high propulsion gas pressure in the form of a gas pulse, having a pressure of magnitude, 260–300 bar. The manner in which the ignition device is fired makes it impossible to stop the ignition device after it is launched. Also it is not possible to return the ignition device to the launching means. This solution uses a protective tube having a clearance between the ignition pellet (the projectile) and the bore. All the energy for the pellet is supplied before it enters the protective tube (i.e., a normal shot at high pressure).

SUMMARY OF THE INVENTION

An object of the present invention is to provide a method, an apparatus, and an ignition pellet for igniting gases in a flare tower while avoiding the disadvantages described above.

Another object of the present invention is to provide a device for igniting gases in which the ignition pellet is not launched by high pressure, but is guided out of a launching tube which has a continuous supply of propulsion gas.

Another object of the invention is to provide a programmable ignition pellet, which may be stopped after it has been set in motion and which may be returned to the launching means.

Yet another object of the present invention is to provide an ignition pellet which is activated during its movement from the launching means to the flare by an electrical or mechanical device which initiates/activates the ignition pellet.

The present invention provides a controlled and lower speed ignition pellet as compared to known solutions. As a result the required safety zone around the device can be smaller, the danger to helicopter traffic near the flare tower is reduced. Compared to a known solution, the present invention entails far lower investment costs, inter alia, because there is only one pressure level for the propulsion gas system and standard components may be more widely used than in the known solution. The present invention is also more flexible than the known solution by being adaptable to all types of flares.

The above objects are achieved by a method for the ignition of gases in a flare tower or flare in which an ignition device is launched toward a region of a combustible gas. The ignition device is propelled by means of a pressure medium through a guidance tube to the gas cloud region. The ignition device undergoes a reaction which ignites the gas in the gas cloud region. The activation and reaction time is predetermined and adapted to the particular flare and application.

Preferably, the ignition device undergoes a reaction in the form of a shower or cloud of sparks, where at least parts of the shower of sparks strike the cloud of gas.

Preferably, the ignition device is activated somewhere along its path through the tube such as at the moment the ignition device leaves the tube, when the ignition device starts its journey through the tube, or when the ignition device strikes an object (impact plate) in the vicinity of the flare.

The ignition device may be positioned within a trapping device prior to its reaction.

The ignition device may be propelled through the guidance tube at a moderate speed. It may during its passage through the tube. It may turn ground and return to guidance tube without a reaction taking place.

The present invention also is an apparatus for igniting gases in a flare tower or flare by an ignition device which is brought toward a region in or near a cloud of gas. The apparatus includes a guidance tube and a supply of a pressure medium. The ignition device is adapted for propulsion through the guidance tube by means of the pressure medium to place the ignition device close to the cloud of gas for a reaction near or within the cloud of gas.

Preferably, the apparatus comprises a feeding unit, a control device and, optionally, a magazine for the ignition device.

Preferably, an ignition initiator is mounted along the guidance tube to initiate/activate the ignition device which, after a time delay, undergoes a reaction outside the tube, in or near the cloud of gas.

Optionally, the apparatus comprises a trapping device for the ignition device after it has left the tube.

The present invention also is an ignition device for use with the apparatus. The device has the shape of an ignition pellet which is electrically or mechanically activated. The ignition pellet has a built-in delay prior to its reaction. The time for its activation and delay being predetermined and adapted to the particular flare and application.

BRIEF DESCRIPTION OF THE DRAWINGS

In what follows, the invention will be described in more detail with reference to the appended drawings.

DETAILED DESCRIPTION OF PREFERRED EMBODIMENT

Figure 1:
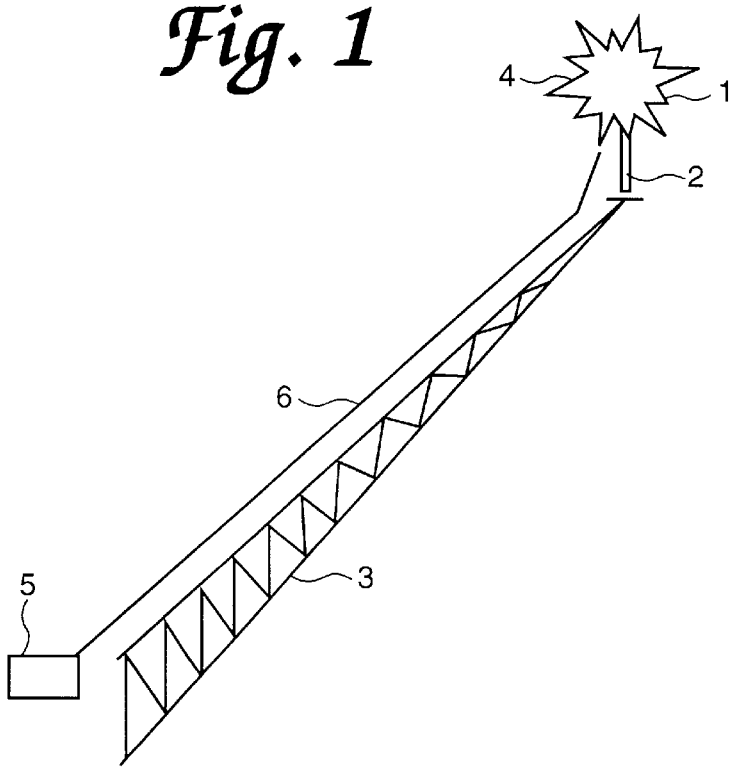
FIG. 1 shows a flare having an apparatus for the ignition of gas according to the present invention.

FIG. 1 showns the principle of igniting a gas flow 1 at a flare 2 at the end of a flare tower 3. An ignition pellet 4 is collected from a supply (for example, a magazine), is loaded into a launching means 5, is ejected by means of a pneumatic post system through a guidance tube 6, undergoes a reaction at the end of the flare 2, and forms a cloud of sparks which ignite the gas flow 1 at the flare 2. The ignition pellet 4 is conducted through the guidance tube 6 and bears against the tube wall for guidance and sealing. Thus, the pellet 4 is not fired as in known apparatus.

Figure 2:
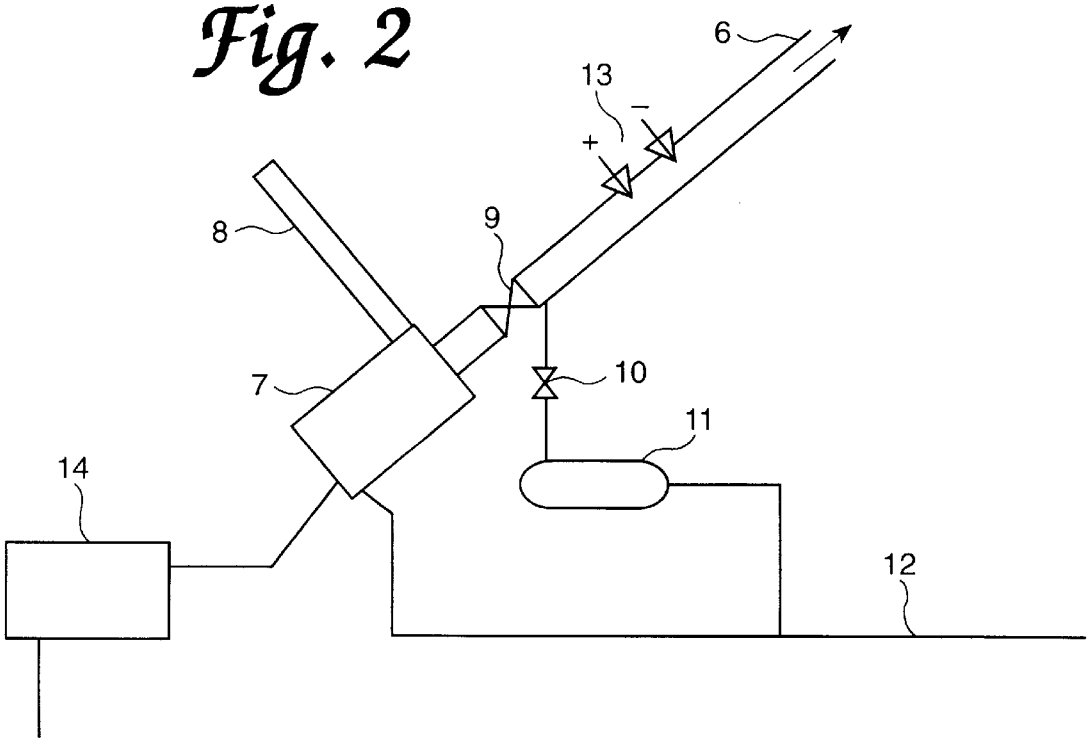
FIG. 2 is a schematic view of a feeding unit and launching means according to the present invention.

In FIG. 2 the main components of the apparatus of the present invention are shown in more detail. The launching means 5 comprises a feeding unit 7 and a magazine 8 for ignition pellets 4. The launching means 5 is connected to the guidance tube 6 by a valve 9. The guidance tube 6 is connected with a propulsion gas supply 12 by a valve 10 and a reservoir tank 11. The launching means 5 is also connected with a control system 14. If the apparatus is to be used with electrically or mechanically activatable ignition pellets 4, a mechanical or electric initiator 13 is mounted on the guidance tube 6. The purpose of this initiator 13 will be described in more detail later.

Ignition takes place by an ignition pellet 4 collected from the magazine 8 and loaded into the launching means 5. From the launching means 5, the ignition pellet 4 is ejected by a propulsion gas, for example pressurized air, having a pressure on the magnitude of 0–20 bar, and propelled into a tube system 6. After the ignition pellet has left the launching means 5, the is closed off because the valve 9 closes. Additional propulsion gas is supplied by the valve 10 opening and admitting propulsion gas, for example, pressurized air, into the tube 6 behind the ignition pellet 4. The valve 10 is connected to a propulsion gas supply 12 which optionally, is connected with a propulsion gas tank 11. The ignition pellet 4 will thereafter be pressed forward through the tube system 6 in accordance with the pneumatic post principle. The movement of the ignition pellet 4 in the tube 6 may be stopped, and the ignition pellet 4 may, optionally, be brought back to the launching means 5 by means of negative pressure.

Figure 5:
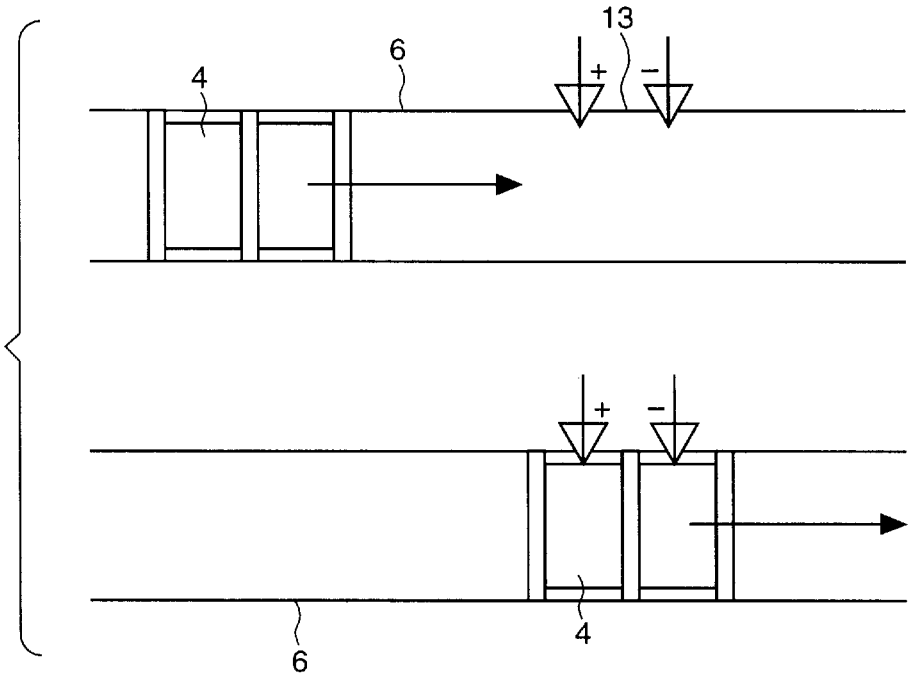
FIG. 5 shows an embodiment of a activator/electric initiator according to the present invention.
Figure 6:
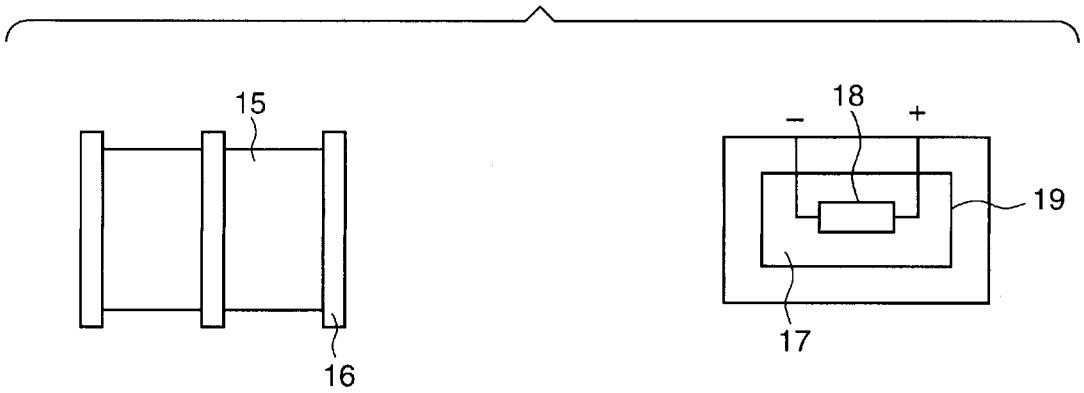
FIG. 6 shows an embodiment of an electric ignition pellet according to the present invention.

The ignition pellet 4 may be either electrically or mechanically activated. When electrically activated ignition pellets 4 are used, these will pass an activator unit 13 comprising, for example, of two contact pieces. An electric impulse is applied to the ignition pellet and an electric igniter starts. This is shown in FIGS. 2, 5, and 6. The ignition pellet 4 may, for example, be designed with an exterior casing 15 and a guide strip 16 which bears against the tube 6, preventing the propulsion gas from leaking past the ignition pellet 4. This is shown on the left side of FIG. 6. The exterior casing 15 may be a conductor carrying current and be connected with an igniter 18 inside the ignition pellet. This is shown on the right side of FIG. 6.

The interior of the ignition pellet 4 comprising a fire charge 17, an igniter 18, and a spark-forming medium 19. The igniter 18 may be preprogrammed to go off after a certain period of time.

If the ignition pellet 4 is mechanically activated, the activator unit 13 is unnecessary. When the ignition pellet 4 is fetched from the magazine 8, the pellet 4 is activated by the removal of the safety device. The ignition pellet 4 is thereafter sent into the guidance tube 6. When the pellet 4 leaves the guidance tube 6, the pellet is set off by the release of the mechanical safety device. This can be solved, for example, by means of an activator of the hand grenade type. The ignition pellet is programmed for a time delay and may go undergo its reaction either in the middle of the gas cloud or in a basket.

Figure 3:
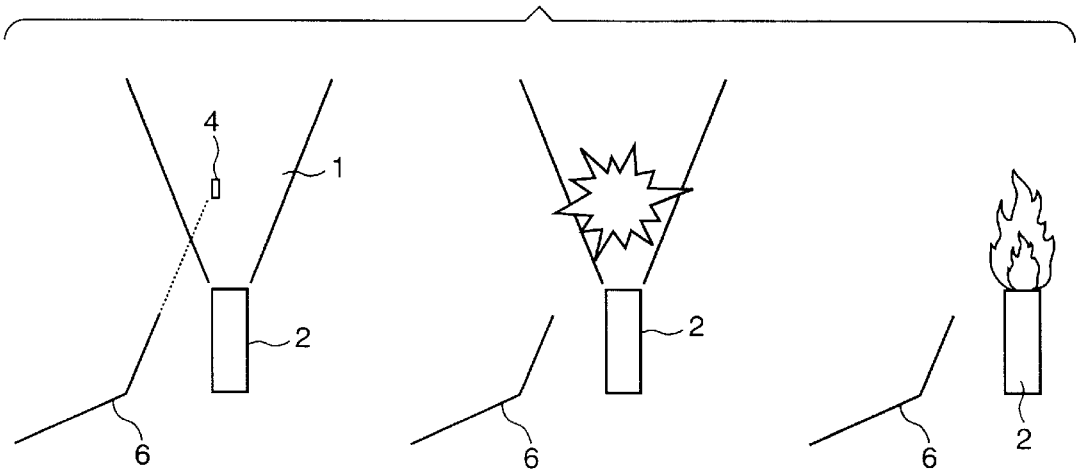
FIG. 3 shows an embodiment of the upper end of the apparatus according to the present invention.
Figure 4:
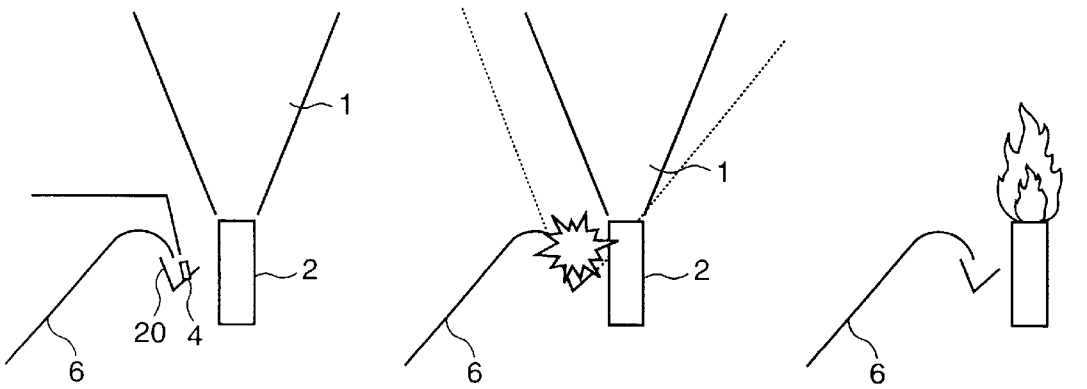
FIG. 4 shows another embodiment of the upper end of the apparatus according to the present invention.

Two different ways in which the reaction of the ignition pellet 4 may occur are shown in FIGS. 3 and 4. In FIG. 3, the ignition pellet 4 continues on a free path into the cloud of gas 1 after it has left the guidance tube 6. The ignition pellet 4 is programmed to undergo a reaction when it is in the middle of the gas cloud 1. The other possibility is that the ignition pellet 4 lands in a basket after it has left the guidance tube 6, as shown in FIG. 4. The pellet remains in the basket 20 until its reaction. This solution demands less precision with respect to the time of ignition. The basket 20 is formed so that the sparks will be dispersed in the most favorable area with respect to the ignition of the gas cloud 1.

The present invention may also use ordinary ignition pellets 4, which react upon impact. In that case a tube having a length of about 100 m and a propulsion gas having a low pressure on the magnitude of 10–20 bar may be used. Since the ignition pellets 4 react on impact, an impact plate (not shown) must be mounted at the outlet of the guidance tube 6.

We claim:

1. A method for igniting combustible gases from a flare of a flare tower, said method comprising:

an ignition device launched toward a region of combustible gas;

said ignition device propelled by a low pressure medium through a guidance tube to said combustible gas region;

said ignition device itself undergoing a reaction to ignite the gas in said combustible gas region, the time for activation and reaction being predetermined and adapted to the particular flare and application; and said ignition device reacting in a shower or a cloud of sparks, where at least parts of said shower of sparks strike said combustible gas region, wherein said ignition device is activated along its path in said guidance tube either when said ignition device exits said guidance tube or when said ignition device starts through said guidance tube.

2. The method as claimed in claim 1, wherein said ignition device is positioned within a trapping device prior to reacting.

3. The method as claimed in claim 1 or 2, wherein said ignition device is propelled through said guidance tube, said ignition device is capable of being stopped during its passage through said guidance tube, and after exiting said guidance tube, said ignition device is capable of being turned around and returned to said guidance tube without reacting.

4. An apparatus for igniting combustible gases from a flare of a flare tower by an ignition device brought toward a region in or near a cloud of gas, said apparatus comprising:

a guidance tube;

a supply of a low pressure medium;

a feeding unit;

a control device; and a magazine for said ignition device, wherein said ignition device is propelled through said guidance tube by said low pressure medium to place said ignition device close to said cloud of gas to react near or within said cloud of gas, and wherein an ignition initiator is mounted along said guidance tube, said ignition initiator activating said ignition device, said ignition device reacting, after a time delay, outside said guidance tube, in or near said cloud of gas.

5. The apparatus as claimed in claim 4, said apparatus further comprising:

a trapping device for said ignition device, said trapping device disposed outside said guidance tube whereby said ignition device is positioned within said trapping device prior to reacting.

6. The apparatus as claimed in claim 4, said apparatus further comprising:

a magazine for storing ignition devices to be fed into said guidance tube.

7. An ignition device to be used with an apparatus as claimed in claims 4, 5, or 6, wherein said ignition device has the form of an ignition pellet, said ignition pellet being electrically or mechanically activated, said ignition pellet being activated along its path in said guidance tube either when said ignition pellet exits said guidance tube or when said ignition pellet starts through said tube, said ignition pellet having a predetermined delay prior to reacting, the time for activation and delay being predetermined and adapted to the particular flare and application.

* * * * *